US009073329B2

(12) United States Patent
Sugahara et al.

(10) Patent No.: US 9,073,329 B2
(45) Date of Patent: Jul. 7, 2015

(54) LIQUID DROPLET JETTING APPARATUS

(75) Inventors: Hiroto Sugahara, Ama (JP); Hirofumi Kondo, Tajimi (JP); Shohei Koide, Nagoya (JP); Hiromitsu Mizutani, Ichinomiya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 131 days.

(21) Appl. No.: 13/358,954

(22) Filed: Jan. 26, 2012

(65) Prior Publication Data

US 2012/0249670 A1 Oct. 4, 2012

(30) Foreign Application Priority Data

Mar. 29, 2011 (JP) ..... 2011-072241

(51) Int. Cl.
*B41J 2/165* (2006.01)

(52) U.S. Cl.
CPC ..... *B41J 2/16579* (2013.01); *B41J 2/16526* (2013.01)

(58) Field of Classification Search
None
See application file for complete search history.

(56) References Cited

U.S. PATENT DOCUMENTS

| | | | | |
|---|---|---|---|---|
| 5,500,657 | A | 3/1996 | Yauchi et al. | |
| 6,033,051 | A | 3/2000 | Kaneko | |
| 7,341,327 | B2 * | 3/2008 | Usuda | 347/23 |
| 7,413,278 | B2 | 8/2008 | Kusakari | |
| 2002/0018092 | A1 | 2/2002 | Inui et al. | |
| 2002/0149641 | A1 * | 10/2002 | Du et al. | 347/23 |
| 2005/0122362 | A1 * | 6/2005 | Hasebe et al. | 347/19 |
| 2005/0140718 | A1 | 6/2005 | Usuda | |
| 2005/0146550 | A1 | 7/2005 | Kusakari | |
| 2008/0186343 | A1 | 8/2008 | Suhagare | |
| 2009/0244161 | A1 * | 10/2009 | Yamamoto et al. | 347/17 |
| 2009/0295854 | A1 | 12/2009 | Kawakami et al. | |

FOREIGN PATENT DOCUMENTS

| | | |
|---|---|---|
| JP | H0-464451 | 2/1992 |
| JP | H0-5131644 | 5/1993 |
| JP | 6206320 | 7/1994 |
| JP | H0-8156281 | 6/1996 |
| JP | H10-95132 | 4/1998 |

(Continued)

OTHER PUBLICATIONS

Notice of Reasons for Rejection for Japanese for Patent Application No. 2011-072241 dated Apr. 16, 2013.

*Primary Examiner* — Alejandro Valencia
(74) *Attorney, Agent, or Firm* — Frommer Lawrence & Haug LLP

(57) ABSTRACT

There is provided a liquid droplet jetting apparatus, including: a liquid droplet jetting head in which a plurality of nozzles and a plurality of individual channels are formed; a purge mechanism; a judgment mechanism which judges whether or not a defective nozzle in which a jetting failure occurs is included in purge target nozzles; a heating mechanism which heats a liquid in the plurality of individual channels; and a controller which controls the purge mechanism and the heating mechanism. In a case that the judgment mechanism judges that the defective nozzle is included in the purge target nozzles, the controller controls the heating mechanism and the purge mechanism to heat the liquid in a part of the plurality of individual channels, which include an individual channel communicating with the defective nozzle, and to execute the purge operation for the purge target nozzles.

19 Claims, 14 Drawing Sheets

(56) References Cited

FOREIGN PATENT DOCUMENTS

| | | |
|---|---|---|
| JP | 11263024 | 9/1999 |
| JP | 2001-315351 | 11/2001 |
| JP | 2003/291371 | 10/2003 |
| JP | 2004-223829 | 8/2004 |
| JP | 2005/186352 | 7/2005 |
| JP | 2005/219486 | 8/2005 |
| JP | 2006-312325 | 11/2006 |
| JP | 2008-080724 | 4/2008 |
| JP | 2009-101699 | 5/2009 |
| JP | 2009-286074 | 12/2009 |
| JP | 2010-089312 | 4/2010 |

* cited by examiner

LIQUID DROPLET JETTING APPARATUS

CROSS REFERENCE TO RELATED APPLICATION

The present application claims priority from Japanese Patent Application No. 2011-072241, filed on Mar. 29, 2011, the disclosure of which is incorporated herein by reference in its entirety.

BACKGROUND OF THE INVENTION

1. Field of the Invention

The present invention relates to a liquid droplet jetting apparatus which jets liquid droplets.

2. Description of the Related Art

As a liquid droplet jetting apparatus which jets liquid droplets, there has been known a liquid droplet jetting apparatus configured to be capable of performing a purge operation. The purge operation refers to the following operation. That is, when jetting failure occurs in a nozzle, through which the liquid droplets are jetted, due to bubbles and/or dust penetrated into a liquid channel, an increase in viscosity of the liquid caused by drying of the liquid in the nozzle, etc., the liquid in the liquid channel is forcibly discharged from the nozzle to discharge the bubbles etc. causing the jetting failure. In this specification, "the jetting failure" means any kinds of jetting defect. For example, the jetting failure includes a case in which no liquid is jetted from a nozzle, and a case in which a predetermined value of the liquid is not jetted from the nozzle.

As the liquid droplet jetting apparatus described above, for example, there has been known an ink-jet printer which includes an ink-jet head jetting ink droplets, the ink-jet printer further including a detection device which detects the jetting failure of any of the nozzles of the ink-jet head and a purge unit which performs the purge operation for the nozzles. Further, the purge unit includes a purge cap which is installed to the ink-jet head to cover the nozzles and a pump which is connected to the purge cap. When the detection device detects that the jetting failure arises in any of the nozzles, the purge unit drives the pump in a state that the nozzles are covered with the purge cap to reduce pressure in a closed space in the purge cap. As described above, a suction purge in which ink is discharged into the purge cap from the nozzles is performed.

SUMMARY OF THE INVENTION

When the purge operation is performed to clear the jetting failure of a defective nozzle, like the printer described above, it is preferable that strong flow directed toward the nozzle is caused in the liquid channel in order to reliably discharge the bubbles and/or any liquid the viscosity of which is increased, etc., from the defective nozzle. For example, in the printer described above, strong suction force is exerted, by the pump, from a side at which nozzle openings are arranged. On the other hand, however, in the purge operation, the flows directed toward the nozzles arise in all of the liquid channels, and thus the liquid is discharged from all of the plurality of nozzles at the same time. Therefore, the liquid is discharged not only from the defective nozzle in which the jetting failure arises but from normal nozzles. Accordingly, there is generated a problem such that, when the strong flows are caused in the liquid channels by the purge operation in order to clear the jetting failure of the defective nozzle, a large amount of liquid is unnecessarily discharged from the normal nozzles to increase an amount of the liquid to be discarded.

In view of the above, an object of the present teaching is to reliably clear the jetting failure of the defective nozzle by the purge operation and to suppress an entire amount of the liquid to be discharged by the purge operation.

According to an aspect of the present teaching, there is provided a liquid droplet jetting apparatus which jets liquid droplets of a liquid onto a medium, including:

a liquid droplet jetting head having a plurality of nozzles from which the liquid droplets are jetted and a plurality of individual channels which communicate with the plurality of nozzles respectively formed therein;

a purge mechanism which is connected to a plurality of purge target individual channels, among the plurality of the individual channels, to be subjected to a purge operation and which executes the purge operation, wherein flows directed toward purge target nozzles, among the plurality of nozzles, communicating with the purge target individual channels respectively are caused in the liquid in the purge target individual channels to discharge the liquid from the purge target nozzles;

a judgment mechanism which judges whether or not a defective nozzle in which a jetting failure occurs is included in the purge target nozzles;

a heating mechanism which heats the liquid in the plurality of individual channels; and a controller which controls the purge mechanism and the heating mechanism;

wherein in a case that the judgment mechanism judges that the defective nozzle is included in the purge target nozzles, the controller controls the heating mechanism and the purge mechanism to heat the liquid in a part, of the plurality of individual channels, which include the individual channel communicating with the defective nozzle by the judgment mechanism, and to execute the purge operation for the purge target nozzles.

According to the present teaching, in the case that the liquid in the part of the plurality of individual channels of the liquid droplet jetting head which include the individual channel communicating with the defective nozzle by the judgment mechanism is heated to decrease the viscosity of the liquid, the liquid is discharged from the defective nozzle more easily. On the other hand, it is possible that the heating of the liquid is not performed in the individual channels of other normal nozzles. In this case, the viscosity of the liquid is not reduced in the normal nozzles. Thus, it is possible for the defective nozzle to clear the jetting failure even when the liquid discharge force by the purge mechanism is reduced, and the amount of the liquid to be discharged from the normal nozzles is decreased. Accordingly, an entire amount of the liquid to be discharged from the plurality of nozzles by execution of the purge operation can be suppressed. In the present teaching, the heating of the liquid in the individual channel by the heating mechanism and the purge operation by the purge mechanism may be simultaneously executed in a concurrent manner, or the purge operation may be executed after the heating of the liquid is completed. Further, the judgment mechanism may judge the nozzle in which the jetting failure has already arisen as the defective nozzle, or the judgment mechanism may judge the nozzle having a high probability that the jetting failure arises as the defective nozzle.

BRIEF DESCRIPTION OF THE DRAWINGS

FIG. 6B showing the drive pulse signal for heating ink.

DESCRIPTION OF THE PREFERRED EMBODIMENTS

Figure 1:
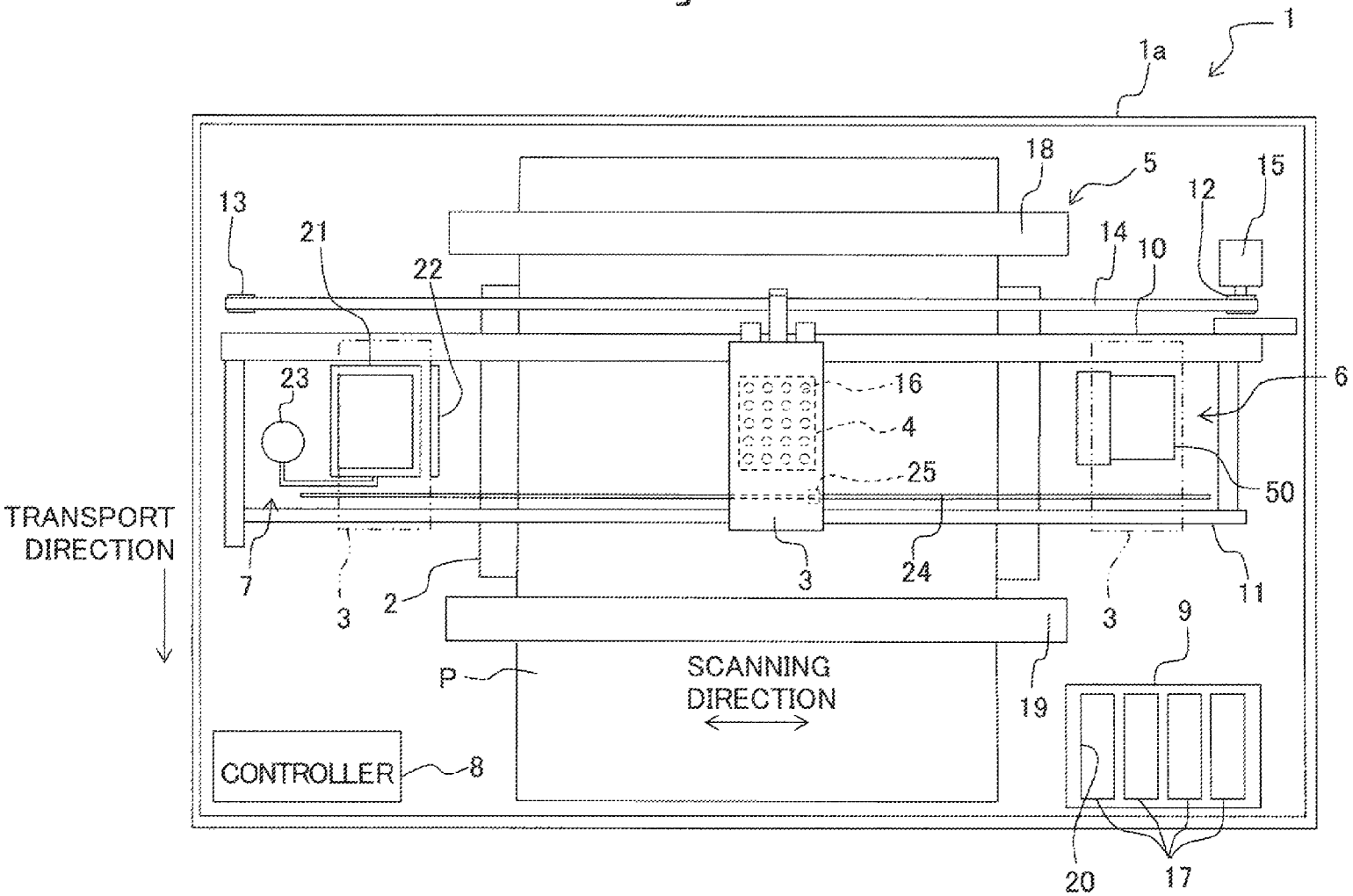
FIG. 1 is a schematic configuration diagram of an ink jet printer according to the present teaching.

Next, an embodiment of the present teaching will be explained. As shown in FIG. 1, an ink-jet printer 1 (liquid droplet jetting apparatus) is provided with a platen 2 on which a recording paper sheet P is placed, a carriage 3 which is reciprocatively movable in a scanning direction parallel to a plane direction of the platen 2, an ink-jet head 4 (liquid droplet jetting head) mounted on the carriage 3, a transport mechanism 5 which transports the recording paper sheet P in a transport direction perpendicular to the scanning direction, a jetting state detection unit 6 (jetting state detection mechanism) which detects the liquid droplet jetting state of each of the nozzles 16 of the ink-jet head 4, a maintenance unit 7 (purge mechanism) which performs various maintenance operations in relation to recovery and maintenance for the liquid droplet jetting performance of the ink-jet head 4, a controller 8 (control device) which is in charge of the control of the entire parts or components of the ink jet printer 1, etc. The main components of the printer 1 will be described below in sequence.

<Construction of Components for Image Recording>

The recording paper sheet P supplied from an unillustrated paper feed mechanism is placed on an upper surface of the platen 2. Two guide rails 10, 11 extending parallel in a left-right direction (scanning direction) of FIG. 1 are provided over or above the platen 2. The carriage 3 is configured to be reciprocatively movable in the scanning direction along the two guide rails 10, 11 in an area facing the platen 2. Further, the two guide rails 10, 11 extend in the scanning direction between two positions separated from the platen 2 in the leftward direction and the rightward direction, as shown in FIG. 1. The carriage 3 is constructed to be movable from a recording area facing the recording paper sheet P on the platen 2 to non-recording areas located at positions separated from the platen 2 in the left and right directions, respectively. Further, an endless belt 14 wound and applied between two pulleys 12, 13 is connected to the carriage 3. When the endless belt 14 is driven to travel by a carriage driving motor 15, the carriage 3 is moved in the scanning direction in accordance with the travel of the endless belt 14.

Further, a printer body 1*a* of the printer 1 is provided with a linear encoder 24 having a number of light transmission portions (slits) which are arranged while providing spacing distances in the scanning direction. On the other hand, the carriage 3 is provided with a transmission-type photo sensor 25 having an unillustrated light-emitting element and an unillustrated light-receiving element. The printer 1 is constructed so that the present position of the carriage 3 in the scanning direction can be recognized from a counted value (the number of times of detection) of the light transmission portions of the linear encoder 24 detected by the photo sensor 25 during the movement of the carriage 3.

The ink jet head 4 is attached to a lower portion of the carriage 3. The lower surface of the ink jet head 4 (the back side of the page of FIG. 1, the surface facing the upper surface of the platen 2) is disposed parallel to the upper surface of the platen 2. The nozzles 16 are formed on the lower surface of the ink jet head 4 to form a liquid droplet jetting surface. Further, as shown in FIG. 1, a holder 9 is fixedly provided in the printer body 1*a* of the printer 1. Four ink cartridges 17 which contain four color inks (black, yellow, cyan, magenta) respectively are attached to four cartridge installing sections 20 of the holder 9. These ink cartridges 17 are exchangeable. Further, although illustrations are omitted, the ink-jet head 4 mounted on the carriage 3 is connected to the holder 9 by four tubes (illustrations thereof are omitted), and the inks in the four ink cartridges 17 are respectively supplied to the ink-jet head 4 via the four tubes. The ink-jet head 4 jets the four color inks from the nozzles 16 toward the recording paper sheet P placed on the platen 2. Detail of the structure of the ink-jet head 4 will be described later.

The transport mechanism 5 has two transport rollers 18, 19 which are arranged to interpose the platen 2, in the transport direction. The recording paper sheet P, which is placed on the platen 2, is transported in the transport direction (frontward direction as viewed in FIG. 1) by the two transport rollers 18, 19.

In the ink-jet printer 1, the ink is jetted from the ink-jet head 4 which is reciprocatively moved in the scanning direction (left-right direction as shown in FIG. 1) together with the carriage 3 with respect to the recording paper sheet P placed on the platen 2. Further, the recording paper sheet P is transported in the transport direction (frontward direction as viewed in FIG. 1) by the two transport rollers 18, 19. Accordingly, the ink-jet printer 1 prints a desired image, letters, and the like, on the recording paper sheet P.

<Structure of Ink-Jet Head>

As shown in FIGS. 2 to 5, the ink-jet head 4 includes a channel unit 30 in which the plurality of nozzles 16 and a plurality of pressure chambers 34 communicated with the nozzles 16 respectively are formed, and a piezoelectric actuator 31 which is arranged on the upper surface of the channel unit 30.

Figure 2:
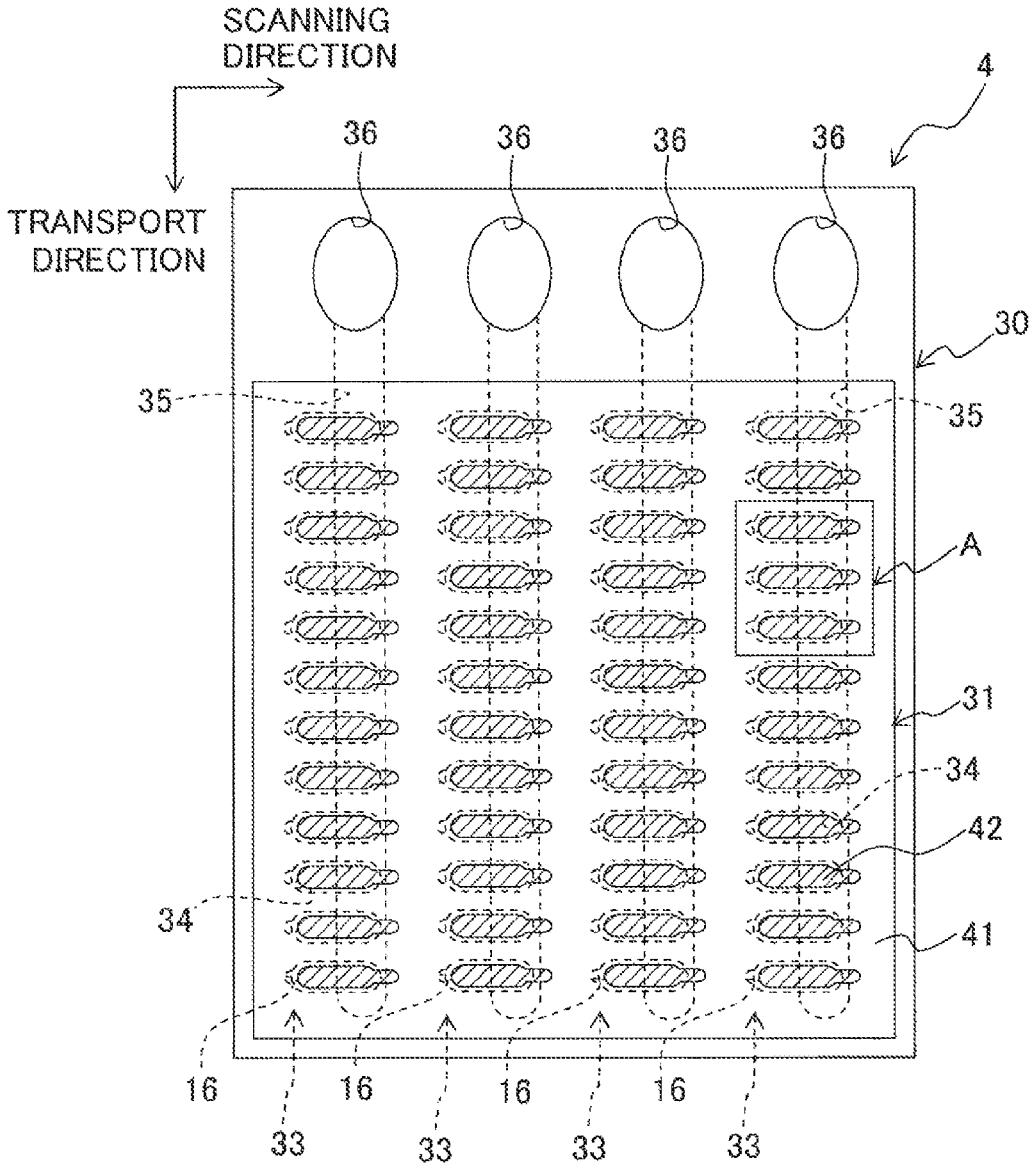
FIG. 2 is a plan view of an ink-jet head.
Figure 3:
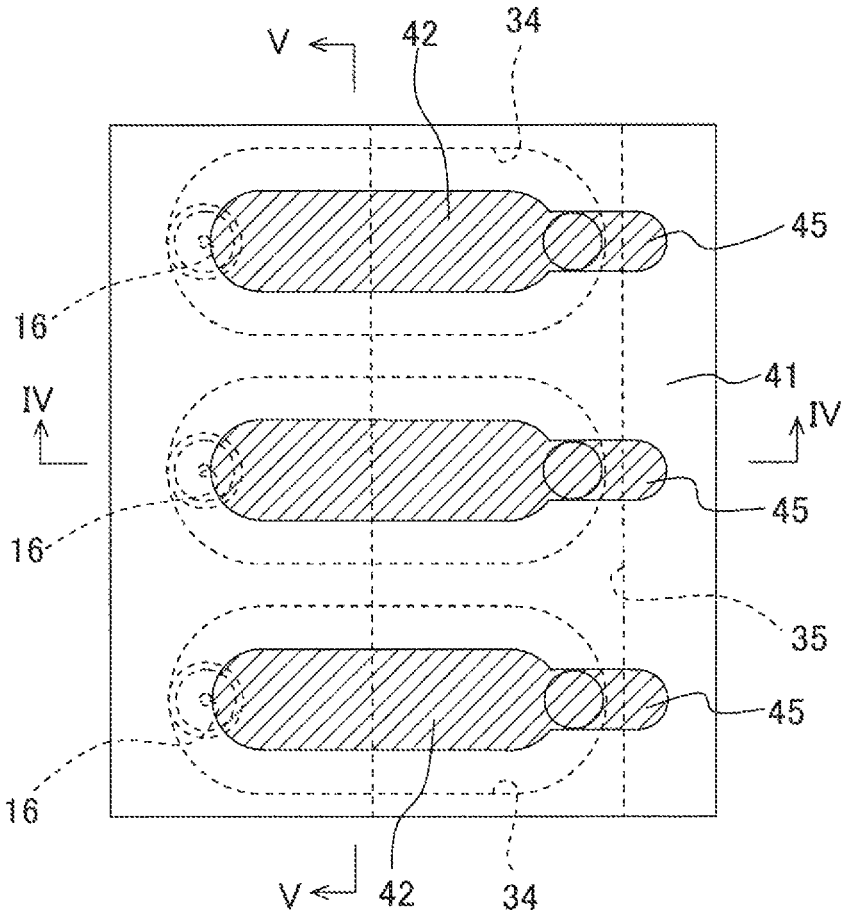
FIG. 3 is an enlarged view of a section A of FIG. 2.
Figure 4:
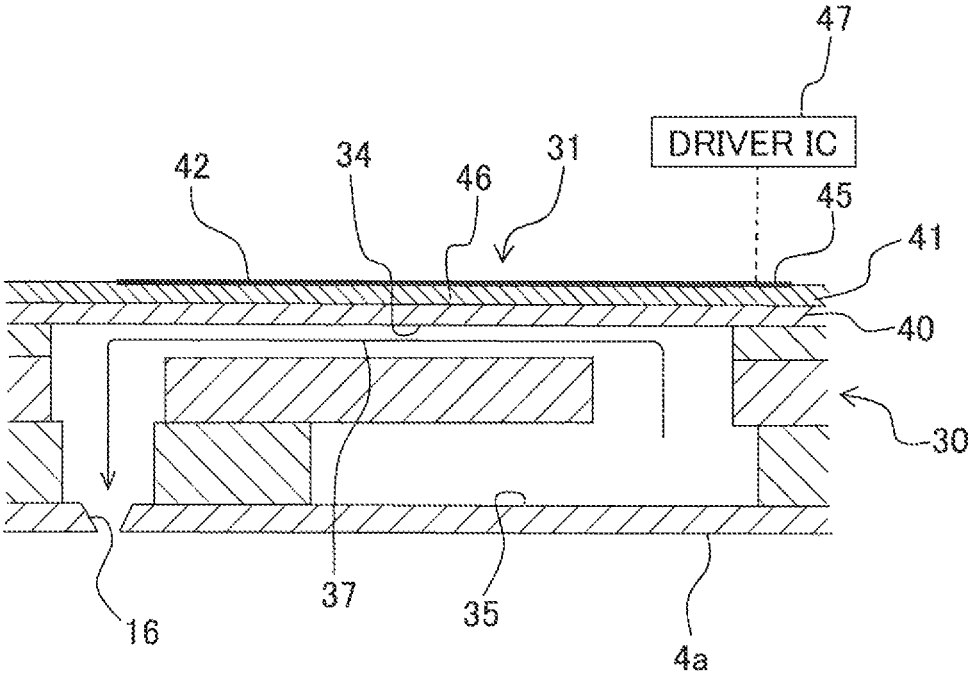
FIG. 4 is a cross-sectional view taken along a line IV-IV of FIG. 3.
Figure 5:
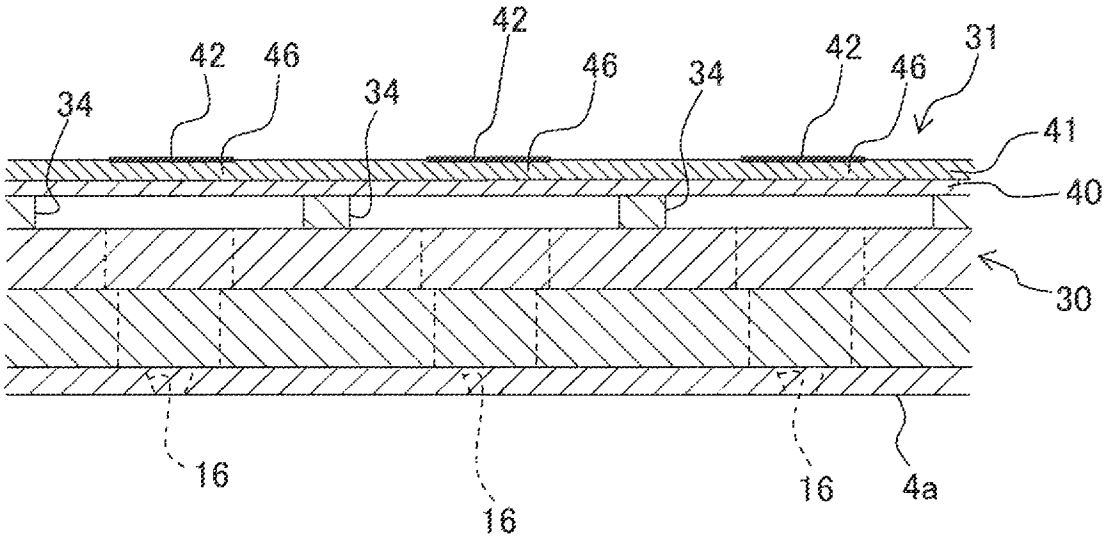
FIG. 5 is a cross-sectional view taken along a line V-V of FIG. 3.

As shown in FIGS. 4 and 5, the channel unit 30 has four stacked plates. The plurality of nozzles 16 are formed on the lower surface (liquid droplet jetting surface 4*a*) of the channel unit 30. As shown in FIG. 2, the plurality of nozzles 16 are arranged to extend in the transport direction to form four nozzle arrays 33 arranged, side by side, in the scanning direction. The four color inks (black, yellow, cyan, magenta) are jetted respectively from the nozzles 16 belonging to the four nozzle arrays 33 respectively.

The plurality of pressure chambers 34, which are communicated with the plurality of nozzles 16 respectively, are formed in the channel unit 30. A plurality of small chambers having openings at upper surfaces of the channel unit 30 are formed in the channel unit 30. These small chambers are covered or closed with a vibration plate 40 of the piezoelectric actuator 31 to form the plurality of pressure chambers 34. Four arrays of the plurality of pressure chambers 34 are arranged as well corresponding to the four nozzle arrays 33. Further, the channel unit 30 is formed with four manifolds 35 which extend in the transport direction respectively and which supply the four color inks of black, yellow, cyan, and magenta to the four arrays of the pressure chambers. The four manifolds 35 are connected to four ink supply ports 36 which are formed on the upper surface of the channel unit 30. As shown in FIG. 4, a plurality of individual channels 37 which range from the manifolds 35 via the pressure chambers 34 to arrive at the nozzles 16 are formed in the channel unit 30.

As shown in FIGS. 2 to 5, the piezoelectric actuator 31 includes the vibration plate 40 which is joined onto the upper surface of the channel unit 30, a piezoelectric layer 41 which is formed on the upper surface of the vibration plate 40 to face the plurality of pressure chambers 34, and a plurality of individual electrodes 42 which are arranged on the upper surface of the piezoelectric layer 41.

The vibration plate 40 is, in a plane view, an approximately rectangular plate member formed of a metallic material such as stainless steels and the like. The vibration plate 40 is joined onto the upper surface of the channel unit 30 to cover the plurality of pressure chambers 34, thereby forming a part of a wall which partitions and defines the pressure chambers 34. The upper surface of the vibration plate 40 having conductivity is opposed to the plurality of individual electrodes 42 with the piezoelectric layer 41 intervening therebetween. The vibration plate 40 plays a role of the common electrode that generates an electric field in a thickness direction in the piezoelectric layer 41. The vibration plate 40 as the above common electrode is connected to a later-described driver IC 47 and is constantly kept at ground potential. It is not indispensable to form the vibration plate 40 by the metallic material, and the vibration plate 40 may be formed of an insulator such as a resin material. In that case, it is allowable to form the common electrode formed of a conductive material on the surface opposite to the channel unit 30 of the vibration plate.

The piezoelectric layer 41, which is made of a piezoelectric material of which major component is lead zirconate titanate (PZT) that is a solid solution of lead titanate and lead zirconate and is a ferroelectric, is formed on the upper surface of the vibration plate 40 (the surface not facing the pressure chambers 34). The piezoelectric layer 41 is formed in a flat or planar form while extending over the pressure chambers 34.

Each of the individual electrodes 42 having a substantially elliptical shape slightly smaller than the pressure chamber 34 as viewed in a plan view is formed on the upper surface of the piezoelectric layer 41. Each of the individual electrodes 42 is arranged at the position facing the center portion of one of pressure chambers 34. Further, a plurality of contact portions 45 are led out from the individual electrodes 42 to areas which are not facing the pressure chambers 34. The contact portions 45 are connected to a flexible printed circuit board (not shown) on which the driver IC 47 (driving device), is installed.

Further, portions of the piezoelectric layer 41 sandwiched between the plurality of individual electrodes 42 and the vibration plate 40 as the common electrode are preliminarily polarized in the thickness direction of the piezoelectric layer 41. These polarized portions of the piezoelectric layer 41 become active portions 46 (corresponding to piezoelectric elements of the present teaching) which generate deformation (piezoelectric deformation) in the piezoelectric layer 41 when voltage is applied between the individual electrodes 42 and the vibration plate 40.

The driver IC 47 (drive device) is installed on the unillustrated flexible printed circuit board connected to the contact portions 45. The driver IC 47 applies a drive pulse signal (see FIG. 6A), which has a pulse P1 having a predetermined pulse width B1 and a predetermined pulse height (driving voltage V), to the respective individual electrodes 42 via a plurality of wiring lines formed on the flexible printed circuit board.

Figure 6A:
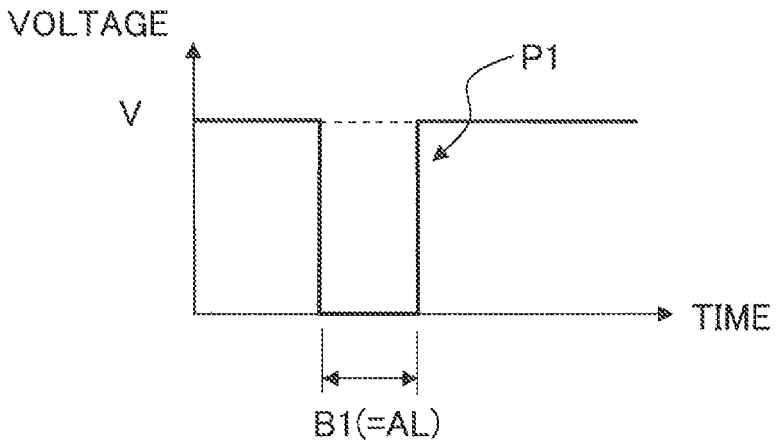
FIGS. 6A and 6B are pulse waveform diagrams of drive pulse signals to be applied from a driver IC to a piezoelectric actuator, FIG. 6A showing the drive pulse signal for jetting liquid droplets.

As is clear from a pulse waveform shown in FIG. 6A, the driver IC 47 applies the driving voltage V to each individual electrode 42 in a standby state during which the pulse P1 is not yet applied. That is, the driving voltage V is applied to the active portion 46 of the piezoelectric layer 41 sandwiched between the individual electrode 42 and the vibration plate 40 as the common electrode, thereby generating the electric field in the thickness direction in the active portion 46. Here, when the direction of the above electric field is same as a polarization direction of the piezoelectric layer 41, the piezoelectric layer 41 extends (elongates) in the thickness direction which is the polarization direction thereof and contracts in a planar direction. With the contraction deformation (deformation due to contraction) of the active portion 46*a*, the portion of the vibration plate 40 facing the pressure chamber 34 is deformed to form a projection toward the pressure chamber 34 (unimorph deformation). That is, a volume of the pressure chamber 34 is decreased in the standby state.

When the driver IC 47 applies the pulse P1 to each individual electrode 42 in the standby state, a potential of the individual electrode 42 becomes the ground potential, so that the active portion 46 comes into a state that no voltage is applied. With this, the vibration plate 40 deformed to form the projection toward the pressure chamber 34 returns to the original form. Thus, the volume of the pressure chamber 34 is increased and a negative pressure wave is generated in the pressure chamber 34. The negative pressure wave is changed to a positive pressure wave at a communicating portion, which communicates with the individual channel 37 and the manifold 35, and the positive pressure wave returns to the pressure chamber 34. That is, the pressure in the pressure chamber 34 is changed between the positive pressure and the negative pressure every propagation time (Acoustic Length; hereinafter referred to as "AL") required for the pressure wave to reciprocate between the pressure chamber 34 and the manifold 35. When the pulse width B1 of the drive pulse signal of FIG. 6A is set to a value which is near the AL, the voltage is applied to the active portion 46*a* at a timing at which the positive pressure wave of which polarity has been changed returns to the pressure chamber 34. In this case, the positive pressure is superimposed to efficiently apply a high pressure (jetting energy) to the ink in the pressure chamber 34. Accordingly, the ink droplets are jetted from the nozzle 16 communicating with the pressure chamber 34.

Figure 6B:
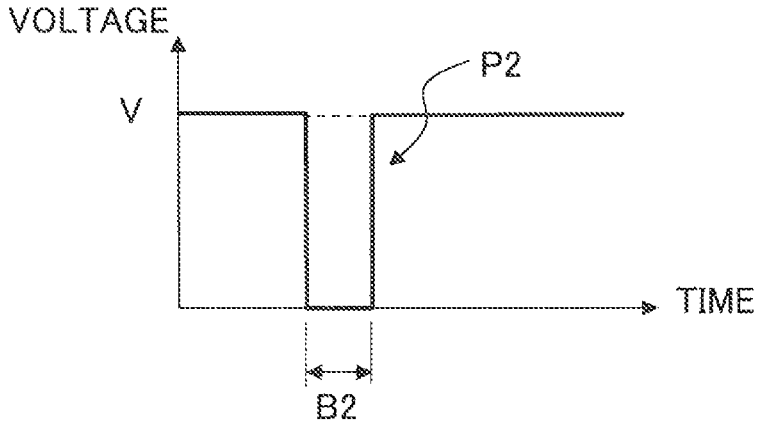

As shown in FIG. 6B, instead of the drive pulse signal for jetting the liquid droplets shown in FIG. 6A, the driver IC 47 is capable of applying, to the individual electrode 42, the drive pulse signal of a predetermined voltage having a pulse width B2 which is different from the pulse width B1 (i.e. AL). This drive pulse signal has the pulse width deviated from the AL. Thus, compared with the drive pulse signal shown in FIG. 6A, efficiency of application of the pressure to the ink in the pressure chamber 34 is inferior. That is, the energy applied to the ink is decreased. Although there is shown an example in which the pulse width B2 in FIG. 6B is smaller than the pulse width B1 in FIG. 6A, the pulse width B2 may be greater than the pulse width B1. The drive pulse signal in FIG. 6B is used for heating the ink in the individual channel 37, as will be described later on. The heating of the ink in the individual channel 37 will be described later.

<Jetting State Detection Unit>

As shown in FIG. 1, a jetting state detection unit 6 which detects the liquid droplet jetting state of each of the nozzles 16 of the ink jet head 4 is disposed at a position, which is separated from the platen 2 toward one side in the scanning direction (right side in FIG. 1).

Figure 7:
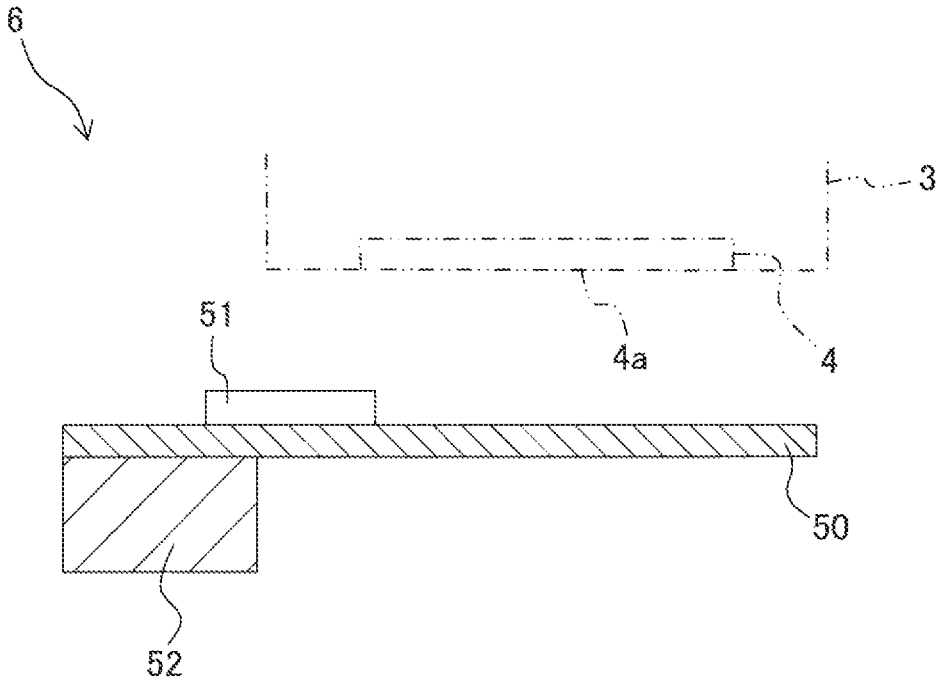
FIG. 7 is a cross-sectional view of a jetting state detection unit.

Although the constitutive parts or components of the jetting state detection unit 6 are not limited to specific constitutive parts or components, an example of the constitutive parts of the jetting state detection unit 6 will be described below. As shown in FIG. 7, the jetting state detection unit 6 includes a liquid droplet landing plate 50 and a deformation detection sensor 51 provided in the liquid droplet landing plate 50.

The liquid droplet landing plate 50 is horizontally supported in a cantilever shape by a support member 52. When the liquid droplet jetted from the nozzle 16 of the ink-jet head 4 lands on the liquid droplet landing plate 50 in a state that the liquid droplet jetting surface 4*a* of the ink-jet head faces the liquid droplet landing plate 50, the liquid droplet landing plate 50 is bent slightly. Further, the deformation detection sensor 51 detects the deformation (bending) of the liquid droplet landing plate 50 when the liquid droplet lands on the liquid droplet landing plate 50. As the deformation detection sensor 51, it is allowable to use publicly known sensors, such as a piezoelectric sensor, a strain gauge, an acceleration sensor, or the like.

On the basis of whether or not the deformation detection sensor 51 detects the deformation (bending) of the liquid droplet landing plate 50 when the drive pulse signal is applied from the driver IC 47 to the individual electrode 42 corresponding to a certain nozzle 16, whether or not the liquid droplet is jetted from the certain nozzle 16 is detected. That is, it is detected whether the nozzle 16 corresponding to the individual electrode 42 to which the drive pulse signal is applied is a normal nozzle which jets the liquid droplet or a defective nozzle which does not jet the liquid droplet (in which jetting failure is caused). When a predetermined amount of the liquid droplet is not jetted from a certain nozzle, that is, when an amount of the liquid droplet jetted from the certain nozzle is smaller than that in a normal state, it may be judged that jetting failure is caused in the certain nozzle. In advance, an amplitude of the output signal of the detection sensor 51, which is outputted when the predetermined amount of the liquid droplet is landed onto the liquid droplet landing plate 50 and which is caused by the deformation (bending) of the liquid droplet landing plate 50, may be stored as a threshold value. In this case, the jetting failure of the certain nozzle can be determined by comparison between the threshold value and an amplitude of the output signal of the detection sensor 51 which is outputted when the liquid droplet is landed onto the liquid droplet landing plate 50.

<Maintenance Unit>

The maintenance unit 7 (purge mechanism) executes a suction purge so that the jetting failure of the nozzle 16 is cleaned or removed, for example, when the jetting state detection unit 6 detects that the jetting failure is caused in a part of the nozzles 16. As shown in FIG. 1, the maintenance unit 7 is provided at a position disposed on the side opposite to the jetting state detection unit 6 with respect to the platen 2. In FIG. 1, the maintenance unit 7 is disposed on the left side of the platen 2. The maintenance unit 7 is provided with a cap member 21 which comes into close contact with the lower surface (liquid droplet jetting surface 4*a*) of the ink-jet head 4 to cover the nozzles 16, a suction pump 23 which is connected to the cap member 21, and a wiper 22 which wipes the ink adhered on the liquid droplet jetting surface 4*a*, etc.

Figure 8:
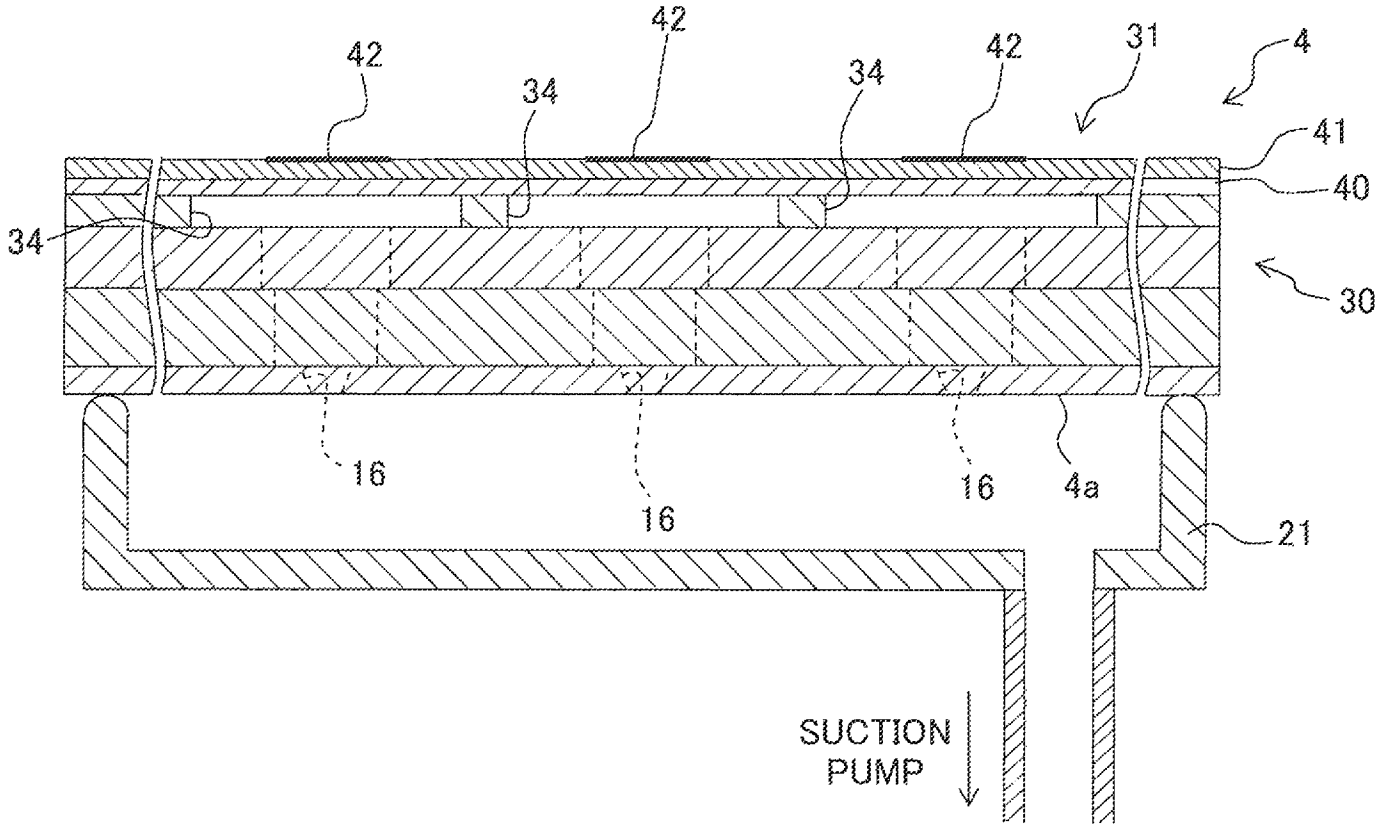
FIG. 8 is a cross-sectional view of the ink-jet head and a cap member in a state that the ink-jet head is covered with the cap member (capping state).

The cap member 21 is configured to be movable in the upward-downward direction of FIG. 8. The cap member 21 is driven by an appropriate cap driving mechanism including a cap driving motor 26 (see FIG. 9) so that the cap member 21 approaches to or separates from the liquid droplet jetting surface 4*a* of the ink-jet head 4. When the cap member 21 is brought in tight contact with the liquid droplet jetting surface 4*a* of the ink-jet head 4 (capping state), all of the nozzles 16 are covered in common to connect the individual channels 37 to an inner space defined by the cap member 21 and the liquid droplet jetting surface 4*a*. When the suction pump 23 sucks air in the above cap member 21 to reduce the pressure in the above state, flows of ink directed toward the nozzles 16 are caused in the individual channels 37, respectively. Accordingly, the ink is discharged to the cap member 21 from the nozzles 16 at the same time (suction purge). When the suction purge is performed, the dust, the bubbles, any ink the viscosity of which is increased due to drying (viscosity-increased ink), etc., those which cause the jetting failure of the nozzle 16 are discharged from the nozzles 16 together with the ink. By performing the suction purge, almost all of the ink in the individual channels 37 can be discharged. Here, a new ink is supplied from each manifold 35 to each individual channel 37 after the suction purge. Thus, a recording operation to be performed thereafter by the ink-jet head 4 can be satisfactorily or successfully performed.

The wiper 22 is provided to stand at a position closer to the platen 2 than the cap member 21. After the suction purge, the carriage 3 moves in the scanning direction in a state that a tip portion of the wiper 22 is brought in contact with the liquid droplet jetting surface 4*a* of the ink-jet head 4, and thereby the wiper 22 wipes the ink adhered on the liquid droplet jetting surface 4*a*. Note that the following configuration is allowable. That is, the wiper 22 moves with respect to the liquid droplet jetting surface 4*a* of the ink jet head 4 in a stationary state to wipe the ink adhered on the liquid droplet jetting surface 4*a*.

<Control Structure of Printer>

Figure 9:
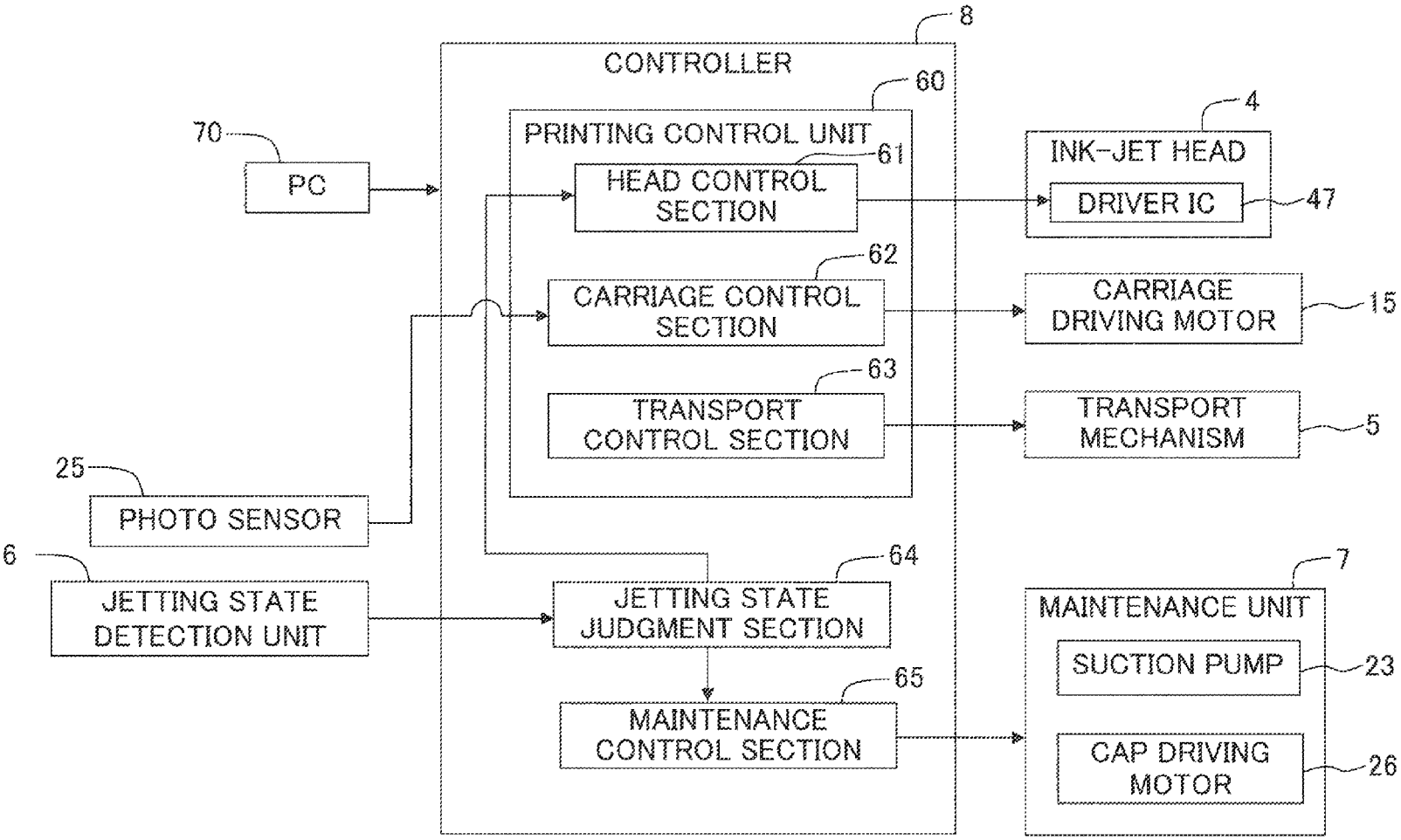
FIG. 9 is a schematic block diagram of a controller of the printer.

Next, an explanation will be made with reference to a block diagram shown in FIG. 9 about the control system of the ink-jet printer 1 including the controller 8 as a main device. The controller 8 of the printer 1 shown in FIG. 9 includes a microcomputer including, for example, Central Processing Unit (CPU), Read Only Memory (ROM) which stores, for example, various programs and data for controlling the overall operation of the printer 1, and Random Access Memory (RAM) which temporarily stores, for example, data to be processed by CPU. The program stored in ROM is executed by CPU, and thus various control operations are performed as explained below. Alternatively, the controller 8 may be based on a hardware in which various circuits including a calculation circuit are combined.

The controller 8 has a printing control unit 60 including a head control section 61 which controls the ink-jet head 4, a carriage control section 62 which controls the carriage driving motor 15 for driving the carriage 3 in the scanning direction, and a transport control section 63 which controls the transport mechanism 5. The printing control unit 60 controls the driver IC 47 of the ink-jet head 4, the carriage driving motor 15, and the transport mechanism 5 respectively on the basis of the data (printing data) which relates, for example, to an image to be printed and which is inputted from a PC (Personal Computer) 70 so that the printing is performed on the recording paper sheet P.

The controller 8 further includes a jetting state judgment section 64 (judgment mechanism) and a maintenance control section 65. The jetting state judgment section 64 judges whether or not each of the nozzles 16 is the defective nozzle based on each of the detection results obtained by the jetting state detection unit 6. When the jetting state judgment section 64 judges that any one of the nozzles 16 is the defective nozzle, the maintenance control section 65 controls the suction pump 23 of the maintenance unit 7, the cap driving motor 26 for moving the cap member 21 upwardly/downwardly, etc., to execute the series of maintenance operation including the suction purge as described above.

The respective functions of the printing control unit 60, the jetting state judgment section 64, and the maintenance control section 65, are realized, actually, by the operation of the microcomputer described above or the operation of various circuits including an arithmetic circuit.

Next, the series of maintenance operation ranging from the judgment of the jetting failure of the nozzle 16 to the suction purge will be described. At first, the jetting state detection unit 6 detects the liquid droplet jetting states of the nozzles 16 of the ink-jet head 4 individually. The detection is performed, for example, at a timing immediately after the printer 1 is turned on or a timing at which a predetermined period of time was elapsed after the previous purge operation is performed. Then, the jetting state judgment section 64 judges whether or not each of the nozzles 16 is the defective nozzle based on each of the detection results.

When the jetting state judgment section 64 judges that there is the defective nozzle in which the jetting failure arises, the jetting state judgment section 64 sends, to the head control section 61, a signal to require the heating of the ink in the individual channel 37 of the defective nozzle. When the head control section 61 receives the signal, the head control section 61 controls the driver IC 47 of the ink-jet head 4 to apply the drive pulse signal for heating the ink as shown in FIG. 6B only to the individual electrode 42 corresponding to the defective nozzle.

When the drive pulse signal (for heating the ink) is applied to the individual electrode 42 corresponding to the defective nozzle from the driver IC 47, the vibration plate 40 deforms in the portion facing the pressure chamber 34 corresponding to said individual electrode 42, and thus the energy is applied to the ink in the pressure chamber 34. Here, when the drive pulse signal is applied, the pressure of the ink is increased by the energy applied to the ink in the pressure chamber 34, and temperature of the ink is increased by conducting, to the ink, self-heating generated by dielectric loss of the piezoelectric layer 41 which corresponds to the equivalent series resistance and the self-heating generated by hysteresis loss.

Accordingly, when the drive pulse signal for heating the ink as shown in FIG. 6B is applied to the individual electrode 42 corresponding to the defective nozzle, the ink in the individual channel 37 including the pressure chamber 34 is heated, thereby decreasing the viscosity of the ink. For example, when the temperature of the ink is increased from approximately 25 degrees Celsius to approximately 45 degrees Celsius, the viscosity of the ink is decreased from approximately 3 cP to approximately 1.5 cP. When the viscosity of the ink decreases by half, a flow rate of the ink in the channel doubles. On the other hand, the driver IC 47 does not apply the drive pulse signal to the individual electrodes 42 corresponding to normal nozzles 16 (non-defective nozzles). Thus, the viscosity of the ink in the individual channel 37 of each of the normal nozzles 16 hardly decreases (for example, the viscosity in approximately 25 degrees Celsius is approximately 3 cP). That is, the viscosity of the ink in the defective nozzle is lower than that in the normal nozzle. This makes it easy to discharge the bubbles etc. from the defective nozzle during the suction purge. According to the inventors' knowledge and perception, it can be assumed that, if the drive pulse signal for heating the ink is applied for a few seconds, the temperature of the ink in the individual channel 37 communicating with the defective nozzle can be increased from approximately 25 degrees Celsius to approximately 45 degrees Celsius.

In this embodiment, the piezoelectric actuator 31, which applies the pressure (jetting energy) to the ink in the pressure chamber 34 at the time of jetting the liquid droplets, corresponds to a heating mechanism of the present teaching.

Further, the drive pulse signal (FIG. 6B) for heating the ink has the pulse width different from that of the drive pulse signal (FIG. 6A) for jetting the liquid droplets, and the pulse width of the drive pulse signal (FIG. 6B) for heating the ink is deviated from the AL. Thus, the efficiency of application of the energy (pressure) to the ink by the piezoelectric actuator 31 is inferior. Therefore, the energy applied to the ink is smaller as compared with the case in which the liquid droplets are jetted. A specific example of each drive pulse signal is as follows. That is, in FIG. 6A, the drive pulse signal for jetting the liquid droplets is V=20V, B1=AL=6 μs. On the other hand, in FIG. 6B, the drive pulse signal for heating the ink is V=20V, B2=approximately 3 μs. Accordingly, when the drive pulse signal for heating the ink is applied, the liquid droplets are less likely to be jetted from the nozzle 16 and it is hardly caused a situation such that the applied energy is delivered to the outside due to the jetting of the liquid droplets. Further, since the liquid droplets are less likely to be jetted, the wasteful ink consumption (discharge) is suppressed.

As described above, the head control section 61 controls the driver IC 47 to heat only the ink in the individual channel 37 of the defective nozzle. Thereafter, the maintenance control section 65 controls the maintenance unit 7 to drive the cap member 21 and the suction pump 23, thereby executing the suction purge. Here, as also appreciated from FIG. 8, the ink is discharged from all of the nozzles 16 covered with the cap member 21 during the suction purge. Since the viscosity of the ink in the individual channel 37 of the defective nozzle is lower than that in the individual channel 37 of the normal nozzles 16, it is possible to lower suction force (ink discharge force) of the suction purge which is required for discharging the bubbles, the viscosity-increased ink, etc., from the defective nozzle. By reducing the suction force, it is possible to decrease an amount of the ink discharged from the normal nozzles 16. Therefore, an entire amount of the ink discharged from the plurality of nozzles 16 by the suction purge is suppressed. In particular, in a lengthy (long) ink-jet head 4 having a number of nozzles 16, the plurality of nozzles 16 are arranged in a small area. Thus, many nozzles 16 are capped with the cap member 21 at once. Therefore, if the purge operation is performed by the great suction force in order to clear the jetting failure of the defective nozzle, the ink is sucked also from many normal nozzles 16 at the same time, thereby causing the discharge of a large amount of the ink from the normal nozzles 16. According to this embodiment, however, it is possible to contribute prevention of the useless discharge of the ink.

In the above description, the suction purge by the suction pump 23 is performed after the ink in the individual channel 37 of the defective nozzle is heated. However, the suction purge may be started in the middle of the heating of the ink (that is, while the drive pulse signal for heating the ink is applied). In this case, the suction force of the suction pump 23 may be set to be relatively low during the heating, and the suction force may be set to be higher after the heating. Alternatively, it is allowable that the heating of the ink in the individual channel 37 of the defective nozzle is performed in the middle of the suction purge, after the suction purge is started by the low suction force of the suction pump 23.

In particular, in this embodiment, whether or not each of the nozzles 16 is defective nozzle is accurately judged based on the detection result of each liquid droplet jetting state obtained by the jetting state detection unit 6. Based on the judgment, the heating of the ink is performed only to the ink in the individual channel 37 of the defective nozzle. Accordingly, the viscosity of the ink is decreased only in the individual channel 37 of the nozzle 16 in which the jetting failure is actually caused, thereby making it possible to sufficiently suppress the entire amount of the ink discharged by the suction purge.

Further, since the ink in the individual channel 37 of the defective nozzle is heated by applying the energy by the piezoelectric actuator 31 for jetting the liquid droplets, it is unnecessary to provide any exclusive heating mechanism separately. Further, since it is possible to heat the ink for each of the nozzles 16 (each of the individual channels 37), it is possible to heat only the ink in the individual channel 37 of the nozzle 16, which is judged as the defective nozzle, with ease.

Next, modified embodiments in which the above-described embodiment is variously modified will be explained. However, components having the structures similar to those of the above-described embodiment will be denoted by the same reference numerals and symbols, and explanation thereof will be omitted when appropriate.

In the present teaching, a method for reducing the energy applied to the ink at the time of heating the ink is not limited to the method in which the pulse width of the drive pulse signal is changed as in the above embodiment. It is possible, by any other method, to reduce the energy applied to the ink at the time of heating the ink so that the energy applied to the ink at the time of heating the ink is lower than the energy applied to the ink at the time of jetting the liquid droplets from the nozzle 16.

For example, it is allowable that the voltage of the drive pulse signal applied to the individual electrode 42 (active portion 46) from the driver IC 47 at the time of heating the ink in the individual channel 37 is made to be lower than that at the time of jetting the liquid droplets. Further, it is allowable that a rise time of the voltage of the drive pulse signal applied to the individual electrode 42 (active portion 46) from the driver IC 47 is made to be longer than that at the time of jetting the liquid droplets.

Alternatively, the number of pulses of the drive pulse signal may be altered. The following technique is a conventionally known technique in a case that the liquid droplet having a large size is jetted from the nozzle 16. That is, when the number of pulses which is continuously applied for a certain period of time is increased and when the pulse width and a pulse interval are appropriately set so that the energy (pressure) applied by each pulse is superimposed, it is possible to apply very great energy to the ink as compared with the case in which the number of pulses is one. As described above, the energy applied to the ink can also be altered by changing the number of pulses which is continuously applied for the certain period of time.

Further, the actuator for jetting the liquid droplets is not limited to the piezoelectric actuator utilizing the piezoelectric deformation of the piezoelectric element. For example, the actuator for jetting the liquid droplets may be an actuator in which the liquid droplets are jetted from the nozzles 16 by using the rise in pressure generated when the ink is heated and boiled by a heating element. In this case, when the ink in the individual channel 37 is heated, the heat energy applied to the ink by the heating element may be lowered to an extent that the ink is not boiled, as compared with the case in which the liquid droplets are jetted.

Further, the defective nozzle (candidate nozzle) which is judged to have the jetting failure by the jetting state judgment section 64 is a nozzle 16 originally having difficulty in jetting the liquid droplets. Therefore, it is assumed that even if a somewhat great energy is applied to the ink at the time of heating the ink in the individual channel 37, the liquid droplets are less likely to be jetted. In view of this, when the ink is heated, the energy equivalent to the energy for jetting the liquid droplets may be applied to the ink by applying the same drive pulse signal as the drive pulse signal at the time of jetting the liquid droplets to the individual electrode 42. Even in this case, since the case in which the ink is not jetted from the defective nozzle judged to have the jetting failure often occurs, it is possible to heat the ink in the defective nozzle efficiently.

The construction of the device for detecting the liquid droplet jetting states of the nozzles 16 (jetting state detection unit 6) is not limited to that of the above embodiment. For example, the jetting state detection unit 6 of the above embodiment shown in FIG. 7 can only detect, as the jetting failure, the state in which the liquid droplets are not jetted (non-ejection) for each of the nozzles 16. However, the jetting state detection unit may detect an inclination of the jetting direction (a bending of jetting) in addition to, or instead of, the presence or absence of the non-ejection. For example, as the detection unit which detects the bending of jetting in addition to the presence or absence of the non-ejection, there is known a device which detects the liquid droplet jetting state (non-ejection and bending of jetting) for each of the nozzles by using laser light.

The printer 1 may be provided with the heating mechanism for heating the ink in the individual channel 37 of the defective nozzle independently of the actuator for jetting the liquid droplets.

Figure 10:
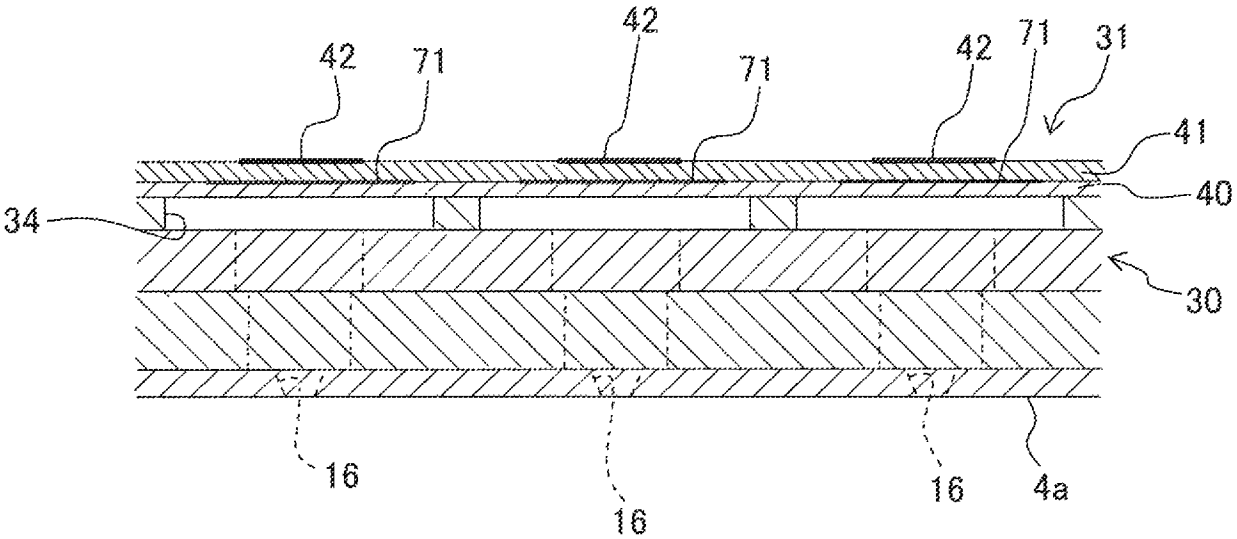
FIG. 10 is a cross-sectional view of the ink-jet head of a modified embodiment which corresponds to FIG. 5.

A plurality of heating elements which heat the ink in the plurality of the individual channels 37 individually may be provided in the ink jet head 4. For example, as shown in FIG. 10, the following configuration is allowable. That is, the vibration plate 40 is made of an insulating material. Further, a plurality of heating elements 71, which are made of a metal having a high electrical resistance and generate heat upon supplying the electric power, may be provided in the areas facing the plurality of the pressure chambers provided on the upper surface of the vibration plate, respectively.

In order to heat the ink for each of the minute nozzles 16 (each of the individual channels 37) individually, like the heating elements 71 described above, each of the heating mechanisms (each of the heating elements 71) is also needed to have a minute size. Further, it is also necessary to draw the plurality of wiring lines corresponding to the heating elements 71. Thus, in view of production cost etc., there is also a disadvantage when the heating mechanisms are provided for each of the individual channels 37. Therefore, the heating mechanism of the present teaching may be a heating mechanism as follows. That is, the ink is not heated for each of the individual channels 37 corresponding to one of the nozzles 16, but the ink is heated for each channel group including the plurality of individual channels 37. For example, the ink-jet head 4 of the above embodiment has four nozzle arrays 33 (nozzle groups) jetting four color inks respectively. The heating mechanism may heat the ink for each of the nozzle arrays 33.

Figure 11:
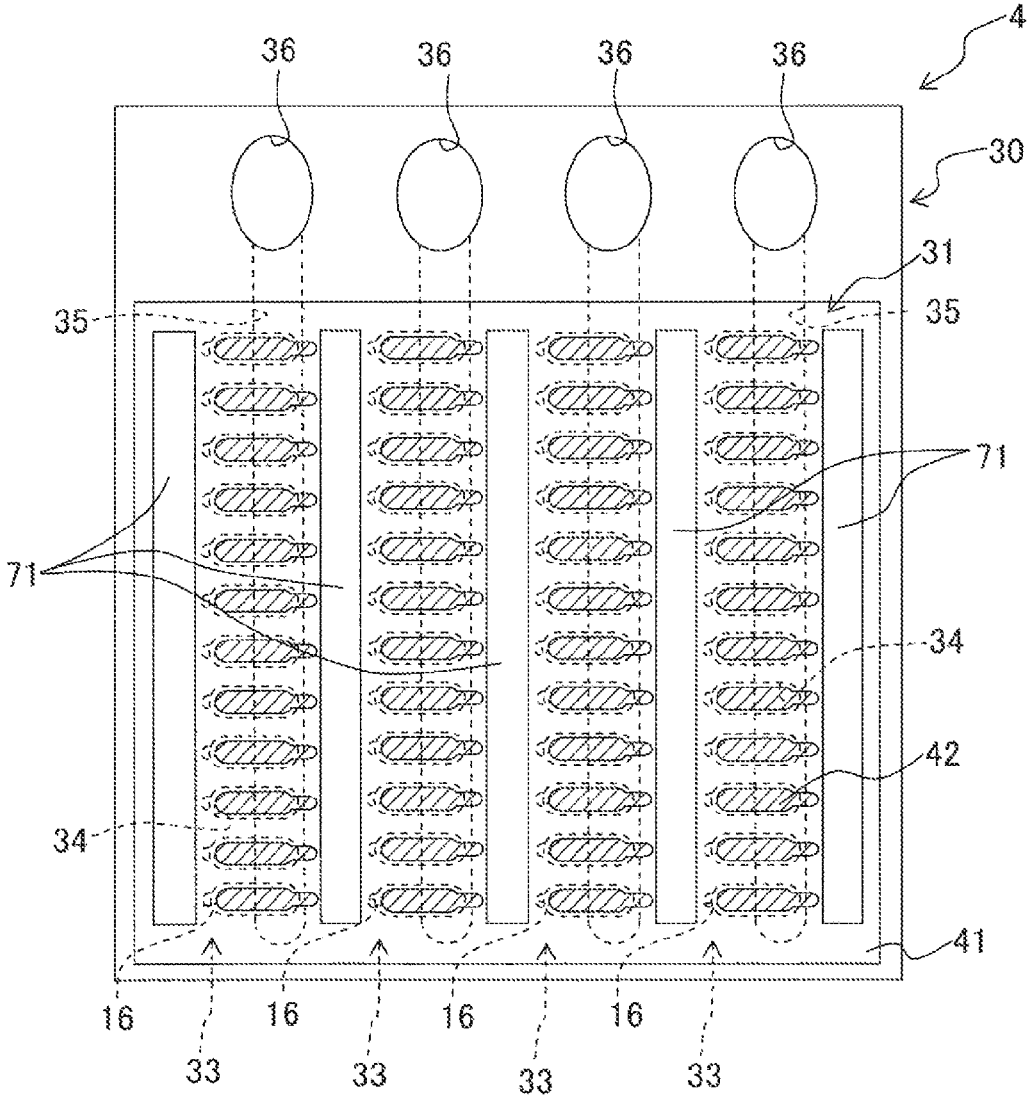
FIG. 11 is a plan view of the ink jet head of a modified embodiment.

FIG. 11 shows a specific example of the preceding paragraph. In FIG. 11, five heating elements 72 (heating mechanisms) in total, each of which has the approximately same length as each of the nozzle arrays 33, are attached on the upper surface of the piezoelectric layer 41 of the piezoelectric actuator 31 at areas placed at outside positions of four nozzle arrays 33 and areas between the adjacent nozzle arrays 33. Two heating elements 72 sandwiching one of the nozzle arrays 33 heat the ink in the individual channels 37 of the nozzles 16, which belong to said one of the nozzle arrays 33 and through which the ink having the same color is jetted, at the same time.

In the construction described above, when the jetting state detection unit 6 judges that some nozzles 16 from which the ink of a color is jetted are defective nozzles, the ink in the individual channels 37, which correspond to all of the nozzles 16 of one of the nozzles arrays 33 to which the defective nozzles are belong, is heated by the two heating elements 72 sandwiching said one of the nozzle arrays 33. In this case, the ink in the individual channels 37, which correspond to the nozzles 16 which are not judged as the defective nozzles among the nozzles 16 belonging to said one of the nozzle arrays 33, is also heated. Therefore, compared with the case of the above embodiment in which only the ink in the individual channel 37 corresponding to the nozzle 16 judged as the defective nozzle is heated, the entire amount of the ink discharged by the purge operation slightly increases. That is, when the heating mechanisms which heat the ink in the individual channels 37 at the same time, such as the heating elements 72, are used, there is an advantage such that the construction of the heating mechanisms is easy as compared with the above embodiment. However, in view of reduction of the amount of the ink to be discharged, the construction, in which the heating of ink can be performed for each of the individual channels 37 as described in the above embodiment, is preferable.

In the above embodiment, the jetting state detection unit 6 detects the liquid droplet jetting states of the plurality of nozzles 16 individually, and thereafter the purge operation is performed by the maintenance unit 7 based on the detection results. However, if there are many nozzles 16, a great deal of time is required to detect the liquid droplet jetting states of the plurality of nozzles 16 individually.

Figure 12:
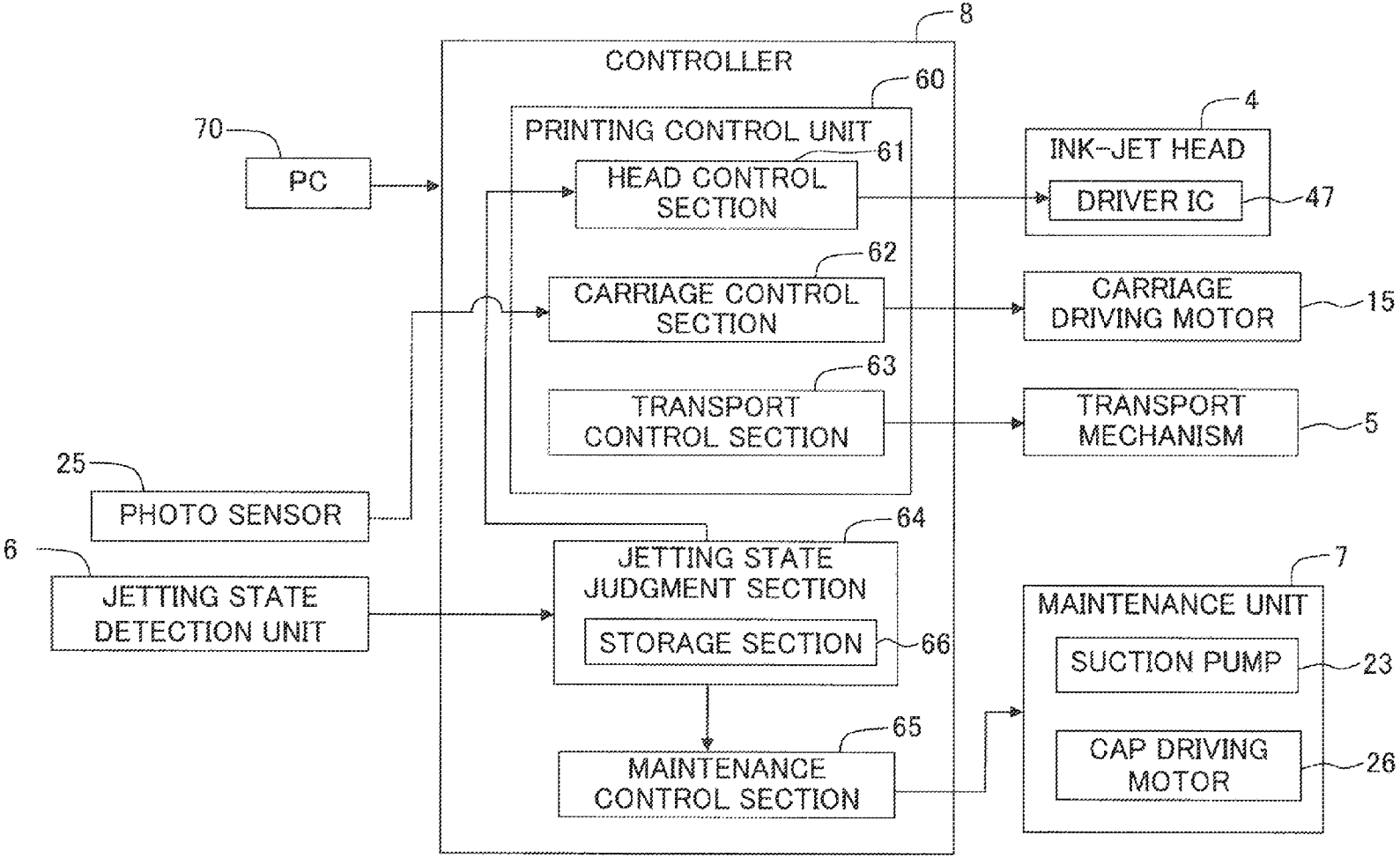
FIG. 12 is a schematic block diagram of the controller of the printer of a modified embodiment.

In view of this, the configuration as shown in FIG. 12 is allowable. That is, the jetting state judgment section 64 includes a storage section 66 (memory) which stores past detection results with respect to the liquid droplet jetting states of the nozzles 16 detected by the jetting state detection unit 6. The jetting state judgment section 64 performs the judgment of the defective nozzle based on the past detection results stored in the storage section. Accordingly, when the judgment (estimation) of the defective nozzle is performed by using the past detection results, it is possible to appropriately omit the detection processes of the liquid droplet jetting states of the nozzles 16, and thereby it is possible to perform the purge operation quickly. It is noted that any memory mechanisms, such as a semiconductor memory, HDD, etc., can be used as the storage section 66.

The nozzle 16 in which more than one jetting failure was detected in the past can be estimated as a nozzle 16 in which the jetting failure is more likely to be caused. Then, in the case that the storage section 66 stores the past detection results, the jetting state judgment section 64 may judge that the nozzle 16, in which the jetting failures are detected not less than a predetermined number of times, is the defective nozzle. By doing so, the judgment (estimation) of the defective nozzle can be performed more accurately.

Some specific examples of the judgment (estimation) of the defective nozzle in accordance with such a manner will be cited. However, the specific examples described below are merely as examples, and the present teaching is not limited thereto. For example, the nozzle 16, in which the jetting failures are detected not less than the predetermined number of times in most recent detection processes, is judged as the defective nozzle. More specifically, in a case that the jetting failures are detected in more than half of the most recent detection processes (for example, in a case that the jetting failures are detected three times or more in the most recent five detection processes), the nozzle in which the jetting failures are detected three times or more is judged as the defective nozzle. Further, it is allowable that the nozzle 16, in which more than one jetting failure is detected consecutively in the most recent detection processes, is judged as the defective nozzle. Or, it is allowable that the nozzle 16, in which the total number of times that the jetting failure was detected in the past (for example, after the use of the printer was started) is not less than the predetermined number of times, is judged as the defective nozzle.

Further, it is allowable to perform the judgment of the defective nozzle by estimating from various conditions without detecting the liquid droplet jetting states of the plurality of nozzles 16 individually.

For example, the following configuration is allowable. That is, the head control section 61 of the controller 8 counts the number of times of jetting of the liquid droplets for each of the nozzles 16 after the last purge operation by the maintenance unit 7 is completed, and then it is judged whether or not each of the nozzles 16 is defective nozzle depending on the number of times of jetting of the liquid droplets.

The nozzle 16, in which the number of times of jetting of the liquid droplets counted from the last purge operation is small, has a high possibility that the increase in viscosity of the ink in the nozzle 16 is progressed. Thus, the jetting state judgment section 64 may judge the nozzle 16, in which the number of times of jetting of the liquid droplets is less than a predetermined number of times (less than a first predetermined number of times), as the defective nozzle. Alternatively, in the individual channel 37 of the nozzle 16, in which the number of times of jetting of the liquid droplets counted from the last purge operation is large, the ink is often supplied from an upstream side and thus the opportunity that the bubbles are carried is increased. Accordingly, the bubbles are more likely to be mixed in the ink. In view of this, on the contrary to the above, the jetting state judgment section 64 may judge the nozzle 16, in which the number of times of jetting of the liquid droplet's is not less than a predetermined number of times (not less than a second predetermined number of times), as the defective nozzle. It is noted that, by combining these conditions, it is also possible to judge the nozzle 16 as the defective nozzle in a case that the number of times of jetting of the liquid droplets counted from the last purge operation is less than the first predetermined number of times or is not less than the second predetermined number of times.

If the liquid droplets are not jetted from a nozzle 16 for a long period of time, the increase in viscosity of the ink in the nozzle 16 is more likely to be progressed. Therefore, the following configuration is allowable. That is, the head control section 61 of the controller 8 measures standby time, during which the liquid droplet is not jetted, for each of the nozzles 16, and then jetting state judgment section 64 judges the nozzle 16, in which the standby time is not less than a predetermined period of time, as the defective nozzle.

Further, in the ink-jet head 4 of the above embodiment, the plurality of nozzles 16 are divided into four nozzle arrays (nozzle groups) from which four types of inks (four color inks) are jetted respectively. In this case, the judgment of the defective nozzle and the heating of the ink may be performed for each of the nozzle arrays (each of the types of inks). Hereinbelow, a specific example will be given.

An interior portion of each of the ink cartridges 17 is usually communicated with the air in a state that each of the ink cartridges 17 is installed to one of the cartridge installing sections 20, so that the ink is supplied from each of the ink cartridges 17 to the ink-jet head 4 quickly in an amount corresponding to ink consumption by the ink jet head 4. Therefore, if each of the ink cartridges 17 is not replaced for the long period of time, the viscosity of the ink in each of the ink cartridges 17 gradually increases due to drying, and thereby the jetting failure is more likely to occur in the nozzle 16.

Figure 13:
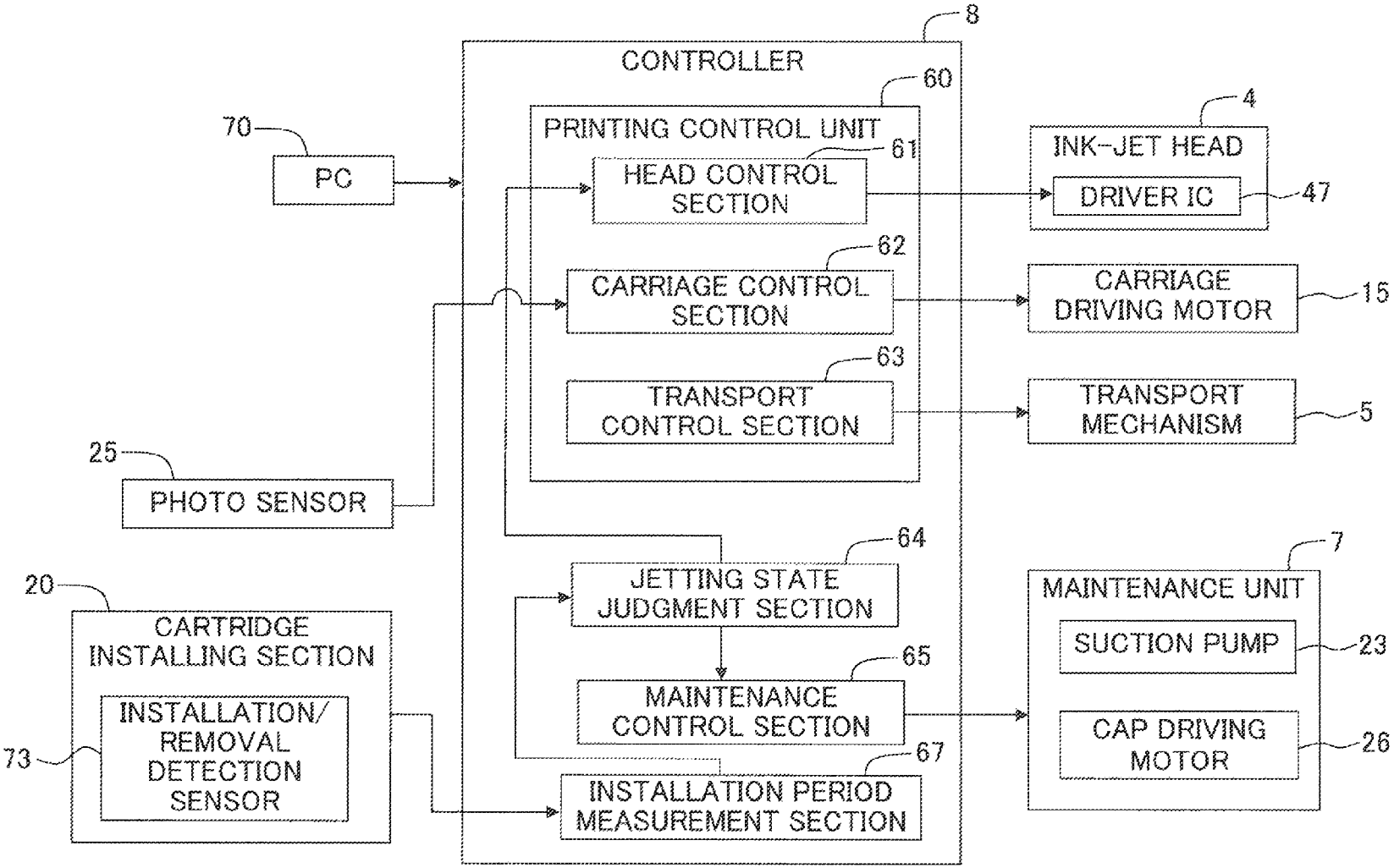
FIG. 13 is a schematic block diagram of the controller of the printer of a modified embodiment.

In view of this, it is allowable that all of the nozzles 16 belonging to the nozzle array 33, in which the ink of the ink cartridge 17 which is not replaced over the predetermined period of time is jetted, are judged as the defective nozzles. In particular, as shown in FIG. 13, installation/removal detection sensors 73 which detect the installation and removal of the ink cartridges 17 are provided in four cartridge installing sections 20, respectively. The controller 8 includes an installation period measurement section 67 which measures an installation period of each of the ink cartridges 17 from when each of installation/removal detection sensors 73 detects the installation of each of the ink cartridges 17 to the present time. In a case that the installation period of the ink cartridge 17 having the ink of a color which is measured by the installation period measurement section 67 is not less than the predetermined period of time, the jetting state judgment section 64 can judge that all of the nozzles 16 belonging to the nozzle array 33 from which the ink of said color is jetted are the defective nozzles.

In the ink cartridge 17 having an old production date, in a case that the produced ink cartridge 17 is not completely enclosed, the drying of the ink is advanced in accordance with passage of time from the production date thereof, and the viscosity of the ink is increased. On the other hand, if a tag etc. indicating the production date is provided in the ink cartridge 17, the printer 1 is capable of grasping the production date of the ink cartridge 17. Accordingly, it is possible to perform the judgment of the defective nozzle based on the production date of the ink cartridge 17, as described below.

Figure 14:
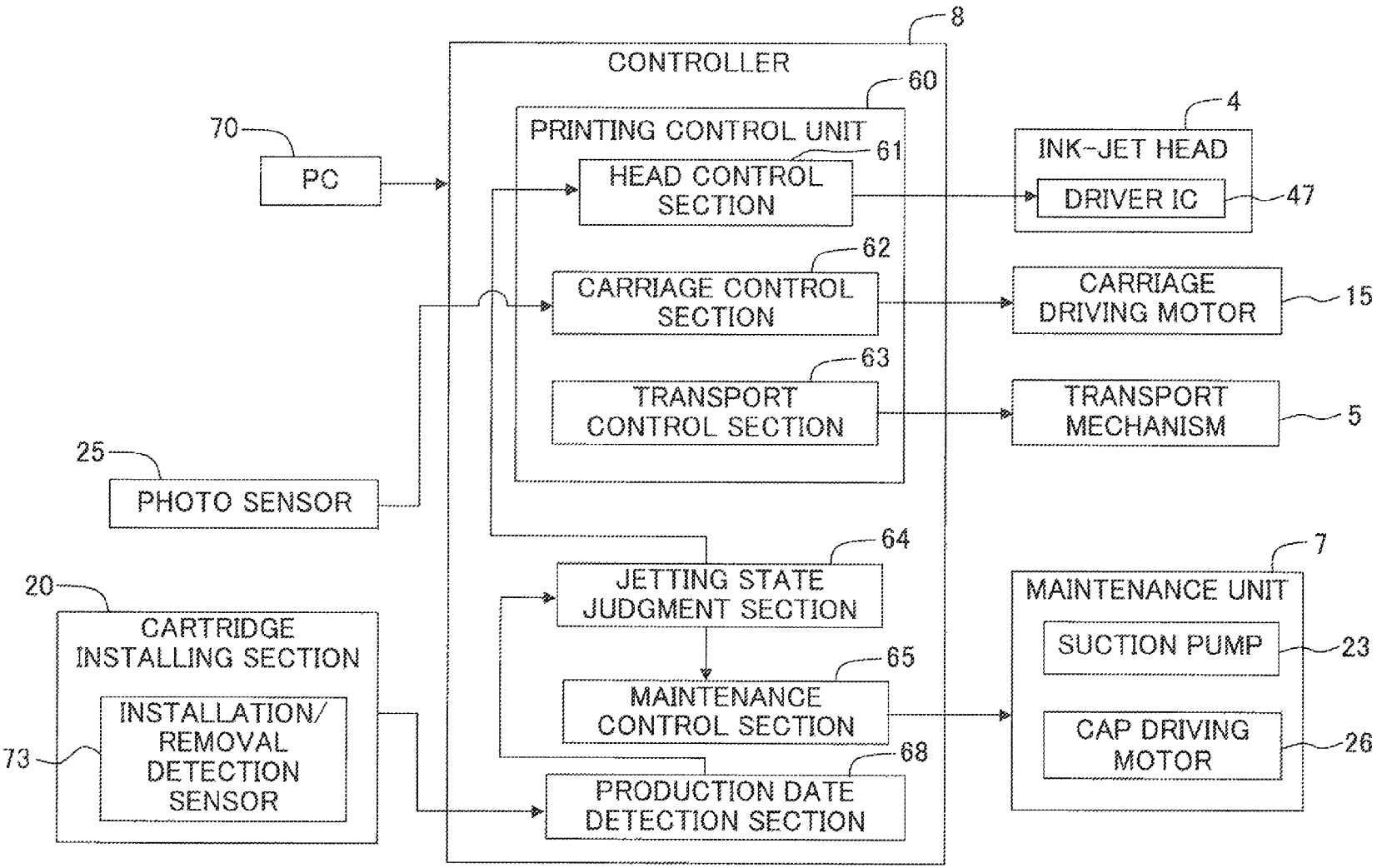
FIG. 14 is a schematic block diagram of the controller of the printer of a modified embodiment.

That is, as shown in FIG. 14, the controller 8 includes a production date detection section 68 which detects the production date based on the tag etc. of the installed ink cartridge 17. The jetting state judgment section 64 calculates (obtains) an elapsed time from the production date of the installed ink cartridge 17 to the present time, based on the production date detected by the production date detection section 68. When the elapsed time is not less than the predetermined period of time, the jetting state judgment section 64 can judge that all of the nozzles 16 belonging to the nozzle array 33 from which the ink of said ink cartridge 17 is jetted are the defective nozzles.

A general ink-jet printer is commonly provided with a mode in which the recording is performed so that only the ink of a specified color is used without always using all types (colors) of inks. For example, in the above embodiment, the printer 1 uses the black ink and three color inks (yellow, cyan, magenta), and is configured as follows. That is, in a case that the recording of a text (character) is performed, a text recording mode (liquid droplet jetting mode) using only the black ink is selected. In a case that the recording of the image is performed, an image recording mode using at least the three color inks is selected. These recording modes may be inputted from the PC 70 as the external apparatus, or the printer 1 (controller 8) may select an appropriate mode based on the recording data inputted from the PC 70.

As described above, in the printer in which one type of recording mode is selected and executed among the plurality of types of recording modes having different types of inks to be used from one another, for example, in a case that the text recording mode using only the black ink is used substantially, the frequency of use of the nozzle arrays 33 of the color inks is reduced. Therefore, the increase in viscosity of the inks in the nozzles 16 belonging to the nozzle arrays 33 of the color inks is more likely to be progressed. In view of this, the following configuration is allowable. That is, the jetting state judgment section 64 derives the nozzle array 33, from which the ink of a color having a low frequency of use is jetted, from the frequency of selection of each of the recording modes. Then, the jetting state judgment section 64 judges all of the nozzles 16 belonging to said nozzle array 33 as the defective nozzles, and the heating of the ink is performed by the heating mechanism. Contrary to the above, the following configuration is also allowable. That is, since the bubbles are more likely to be mixed in the ink in the nozzles belonging to the nozzle array 33 having a high frequency of use, the nozzle array 33 from which the ink of a color having the high frequency of use is jetted is derived, and all of the nozzles 16 belonging to the nozzle array 33 having the high frequency of use are judged as the defective nozzles. Alternatively, by combining these judgment conditions, it is allowable to judge all of the nozzles 16 belonging to the nozzle array 33 from which the ink of a color having the low frequency of use is jetted or the nozzle array 33 from which the ink of a color having the high frequency of use is jetted, as the defective nozzles. It is noted that the frequency of selection (frequency of use) refers to the number of times of selection (the number of times of use) per unit time.

In the above embodiment, the suction purge, in which the ink is discharged by sucking the ink from the side of the nozzle 16, is cited as the purge operation for clearing the jetting failure of the nozzle 16. However, instead of the suction purge, it is allowable to adopt a so-called pressuring purge in which the ink is discharged from the plurality of nozzles 16 by pressuring the ink by the pump etc. connected to the upstream side of the plurality of individual channels 37. Also in this case, provided that the viscosity of the ink in the individual channel 37 of the defective nozzle is reduced before the purge operation, it is possible to clear the jetting failure of the defective nozzle even if the pressure applied by the pump etc. is decreased and it is possible to reduce the amount of the ink to be discharged from other normal nozzles 16.

The embodiment and the modified embodiments thereof explained above have been applied to the ink-jet printer which records the image on the recording paper sheet. However, the problem, in which the nozzle has the jetting failure, may be also caused in any liquid droplet jetting apparatus to be used for any way of use other than the image recording. Therefore, it is also possible to apply the present teaching to liquid droplet jetting apparatuses to be used in various purposes.

What is claimed is:

1. A liquid droplet jetting apparatus which is configured to jet liquid droplets of a liquid onto a medium, comprising:

a liquid droplet jetting head having a plurality of nozzles from which the liquid droplets are jetted and a plurality of individual channels which communicate with the plurality of nozzles respectively formed therein;

a purge mechanism which is connected to a plurality of purge target individual channels, among the plurality of the individual channels, to be subjected to a purge operation and which is configured to execute the purge operation, wherein flows directed toward purge target nozzles, among the plurality of nozzles, communicating with the purge target individual channels respectively are caused' n the liquid in the purge target individual channels to discharge the liquid from the purge target nozzles;

a heating mechanism which is configured to heat the liquid in the plurality of individual channels; and a controller which is configured to control the purge mechanism and the heating mechanism; the controller being configured to judge whether or not a defective nozzle in which a jetting failure occurs is included in the purge target nozzles;

wherein, in a case that the controller judges that the defective nozzle is included in the purge target nozzles, the controller controls the heating mechanism and the purge mechanism to heat the liquid in a part, of the plurality of individual channels, which includes the individual channel communicating with the defective nozzle, and to execute the purge operation for the purge target nozzles;

wherein, in a case that the controller controls the heating mechanism and the purge mechanism to execute the purge operation for the purge target nozzles, the controller controls the heating mechanism so that the heating mechanism applies an energy to heat the liquid in the individual channel communicating with the defective nozzle, the energy being less than a jetting energy for jetting liquid droplets from the nozzle;

wherein, during a period in which the controller controls the heating mechanism to continuously heat the liquid in the plurality of individual channels, the controller controls the purge mechanism to execute the purge operation by applying a first liquid discharge force to the liquid; and wherein, after the period in which the controller controls the heating mechanism to continuously heat the liquid in the plurality of individual channels, the controller controls the purge mechanism to execute the purge operation by applying a second liquid discharge force to the liquid which is greater than the first liquid discharge force.

2. The liquid droplet jetting apparatus according to claim 1;

wherein the controller controls the heating mechanism to heat the liquid only in the individual channel which communicates with the defective nozzle.

3. The liquid droplet jetting apparatus according to claim 1;

wherein the liquid droplet jetting head is provided with an actuator which is configured to apply a jetting energy to the liquid in the plurality of individual channels individually to jet the liquid droplets from the plurality of nozzles selectively; and wherein, in a case that the controller controls the purge mechanism to perform the purge operation, the controller controls the actuator to apply the jetting energy to the liquid in the individual channel communicating with the defective nozzle to heat the liquid in the individual channel.

4. The liquid droplet jetting apparatus according to claim 3;

wherein in a case that the controller controls the actuator to heat the liquid in the individual channel communicating with the defective nozzle, the controller controls the actuator so that the jetting energy applied to the liquid is small as compared with a case in which the liquid droplets are jetted from the plurality of nozzles.

5. The liquid droplet jetting apparatus according to claim 4;

wherein a plurality of pressure chambers communicating with the nozzles are formed in the individual channels, respectively;

wherein the actuator is a piezoelectric actuator including a piezoelectric element which is configured to deform a wall portion defining each of the pressure chambers of one of the individual channels; and wherein the liquid droplet jetting apparatus further includes a driving device which is configured to apply a drive pulse signal having a predetermined voltage to the piezoelectric element.

6. The liquid droplet jetting apparatus according to claim 5;

wherein the controller controls the driving device so that a pulse width of the drive pulse signal, which is applied to the piezoelectric element in a case that the liquid in the candidate individual channel communicating with the candidate nozzle is heated, is different from a pulse width of a drive pulse signal which is applied to the piezoelectric element in a case that the liquid droplets are jetted from the nozzles.

7. The liquid droplet jetting apparatus according to claim 5;

wherein the controller controls the driving device so that a voltage of the drive pulse signal, which is applied to the piezoelectric element in the case that the liquid in the individual channel communicating with the defective nozzle is heated, is lower than a voltage of the drive signal which is applied to the piezoelectric element in the case that the liquid droplets are jetted from the nozzles.

8. The liquid droplet jetting apparatus according to claim 1, further comprising:

a jetting state detection mechanism which is configured to detect a liquid droplet jetting state of each of the nozzles individually;

wherein the judgment mechanism performs a judgment whether or not each of the nozzles is the defective nozzle based on a detection result of the jetting state detection mechanism.

9. The liquid droplet jetting apparatus according to claim 8, further comprising:

a memory which is configured to store the detection result with respect to the liquid droplet jetting state of each of the nozzles detected by the jetting state detection mechanism;

wherein the controller is configured to perform the judgment of the defective nozzle based on the detection result stored in the memory.

10. The liquid droplet jetting apparatus according to claim 9;

wherein the memory is configured to store detection results with respect to liquid droplet jetting states of the plurality of nozzles which are detected by the jetting state detection mechanism a plurality of times; and wherein the controller is configured to judge that a nozzle in which a number of times of detection of the jetting failure is not less than a predetermined number of times is the defective nozzle, based on the detection results detected the plurality of times and stored in the memory.

11. The liquid droplet jetting apparatus according to claim 1;

wherein the controller is configured to judge whether or not each of the nozzles is the defective nozzle depending on a number of times of jetting of the liquid droplets counted after completion of a latest purge operation performed most recently.

12. The liquid droplet jetting apparatus according to claim 1;

wherein the controller is configured to judge that each of the nozzles, in which a standby time period during which the liquid droplets are not jetted is not less than a predetermined period of time, is the defective nozzle.

13. The liquid droplet jetting apparatus according to claim 1;

wherein the plurality of nozzles of the liquid droplet jetting head are divided into a plurality of nozzle groups through which a plurality of types of liquids are jetted respectively;

wherein the purge mechanism includes a cap which is installed to the liquid droplet jetting head to cover the plurality of nozzles constructing the plurality of nozzle groups entirely and a suction mechanism which is connected to the cap, the purge mechanism being configured to execute a suction purge in which the suction mechanism reduces a pressure in the cap to discharge the liquid into the cap from the plurality of nozzles;

wherein the controller is configured to perform a judgment for each of the nozzle groups as to whether or not the defective nozzle is included in each of the nozzle groups; and wherein the controller is configured to control the heating mechanism to heat the liquid in the individual channels communicating with all of nozzles which belong to one of the nozzle groups judged as including the defective nozzle.

14. The liquid droplet jetting apparatus according to claim 13, further comprising:

a plurality of cartridge installing sections to which a plurality types of liquid cartridges containing the plurality of types of liquids respectively are exchangeably installed;

wherein in a case that a liquid cartridge of the plurality of the liquid cartridges is not exchanged over a predetermined period of time, the controller is configured to judge that all of nozzles belonging to one of the nozzle groups through which a type of liquid corresponding to the liquid cartridge is jetted are defective nozzles.

15. The liquid droplet jetting apparatus according to claim 13;

wherein the controller uses a plurality of types of liquid droplet jetting modes in which different nozzle groups are used from each other, and the controller controls the liquid droplet jetting head so that one type of liquid droplet jetting mode is selected and executed; and wherein the controller is configured to perform the judgment as to whether or not the defective nozzle is included in each of the nozzle groups depending on a frequency of selection of each of the liquid droplet jetting modes derived after completion of a latest purge operation performed most recently.

16. The liquid droplet jetting apparatus according to claim 1;

wherein the plurality of nozzles are arranged to form a nozzle array extending in an array direction; and wherein the heating mechanism is a heater which extends in the array direction and is provided commonly for the individual channels communicating with the nozzles included in the nozzle array.

17. The liquid droplet jetting apparatus according to claim 6;

wherein a common liquid chamber which is communicated commonly with the plurality of pressure chambers is formed in the liquid droplet jetting head; and wherein the pulse width which is applied in the case that the liquid droplets are jetted from the nozzles is set to be substantially equal to a propagation time which is a time required for a pressure wave generated at the time of deforming the wall portion to reciprocate between each of the pressure chambers and the common liquid chamber.

18. The liquid droplet jetting apparatus according to claim 1;

wherein, in a case that the controller judges that the defective nozzle is included in the purge target nozzles, the controller additionally controls the heating mechanism and the purge mechanism to not heat the liquid in a part, of the plurality of individual channels, which includes the individual channel communicating with a purge target nozzle that is not defective.

19. The liquid droplet jetting apparatus according to claim 1;

wherein the first liquid discharge force is a first suction force;

wherein the second liquid discharge force is a second suction force; and wherein, in the purge operation, the controller is configured to set the first and second suction forces so that the second suction force applied after heating is greater than the first suction force applied during heating.

* * * * *